United States Patent [19]

Krohn et al.

[11] Patent Number: 4,692,048

[45] Date of Patent: Sep. 8, 1987

[54] PRESSURE ROLLER APPLICATOR

[75] Inventors: Duane D. Krohn, Westminister, Colo.; Allan Boogerman, Bedford, N.H.

[73] Assignee: Graco Inc., Minneapolis, Minn.

[21] Appl. No.: 871,907

[22] Filed: Jun. 9, 1986

[51] Int. Cl.[4] ..... B05C 17/02; B05C 1/10

[52] U.S. Cl. ..... 401/197; 401/208

[58] Field of Search ..... 401/197, 208

[56] References Cited

U.S. PATENT DOCUMENTS 4,231,668 11/1980 Groth et al. ..... 401/197 X 4,597,684 7/1986 O'Brien et al. ..... 401/197

FOREIGN PATENT DOCUMENTS 1003948 3/1952 France ..... 401/197

758351 10/1956 United Kingdom ..... 401/197

*Primary Examiner*—Steven A. Bratlie

*Attorney, Agent, or Firm*—Paul L. Sjoquist

[57] ABSTRACT

A modular pressure feed roller applicator to fit about a double curved liquid delivery tube having modular paint distribution sections held adjacently between two end caps; the modular sections having inner grooves and outer slots cooperatively distributing paint to the inner surface of a permeable roller sleeve for application to the surface being painted.

11 Claims, 3 Drawing Figures

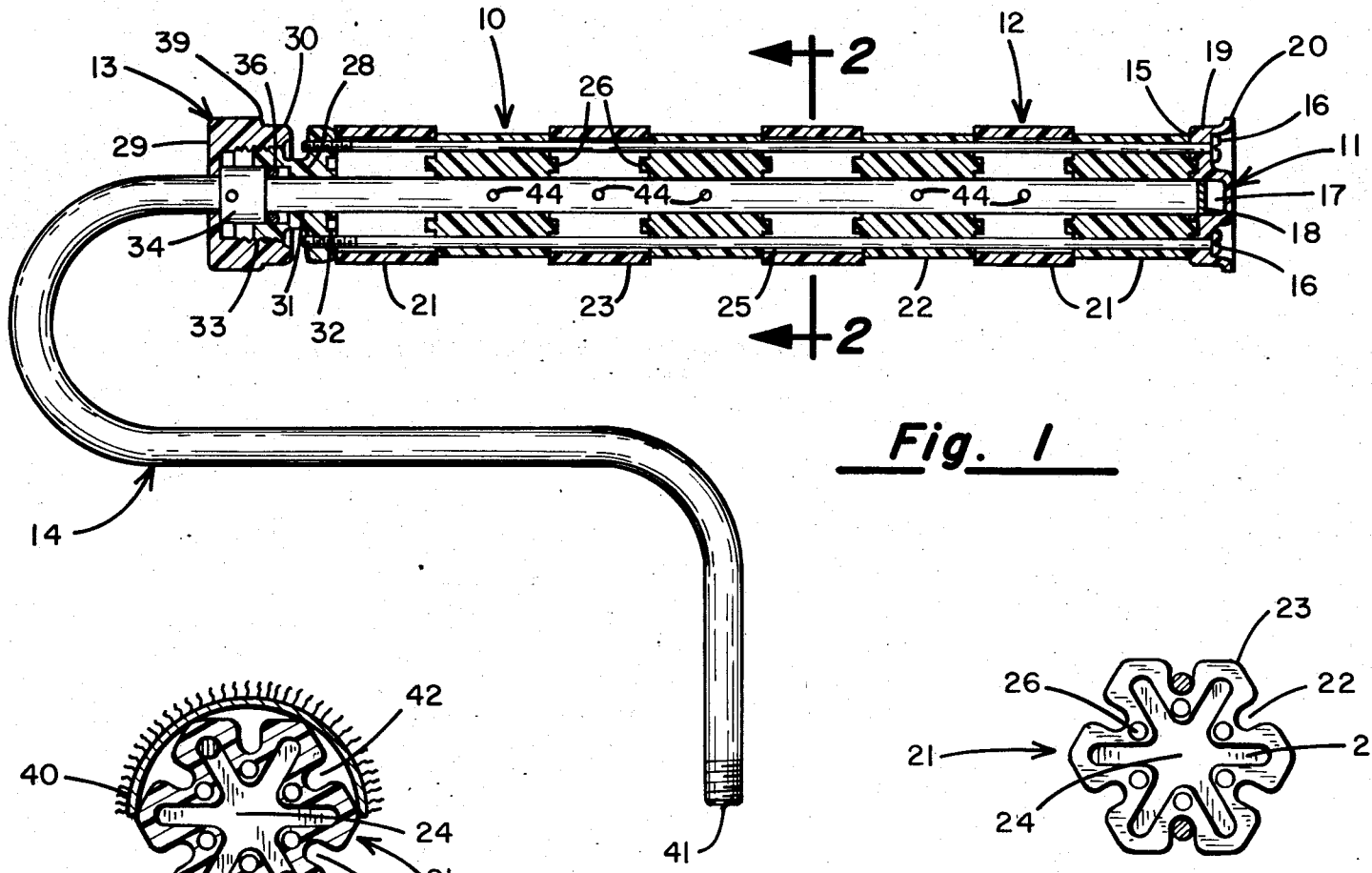
Fig. 1
Fig. 3
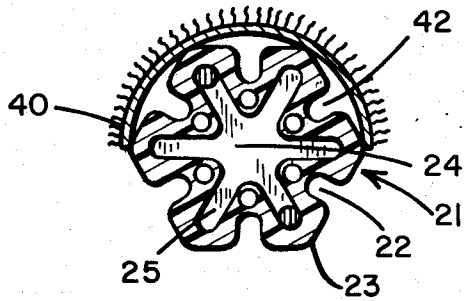
Fig. 2

PRESSURE ROLLER APPLICATOR

BACKGROUND OF THE INVENTION

The present invention relates to the field of liquid coating applicators, and more particularly to roller applicators having continuous liquid feed capability.

A wide variety of paint application devices have been known in the past, particularly roller devices. Some of these previous paint rollers have been designed to provide a continuous supply of paint to the roller surface, and the present invention is an improvement in the capability of rollers for providing a continuous and uniform supply of paint to the roller surface.

When the paint roller first appeared, paint was applied to the roller surface by dipping the roller in a paint supply tray, and the roller was then rolled over the surface being painted to apply the paint. This method of paint transfer provided a discontinuous supply of paint and an uneven distribution of paint over the roller surface requiring the operator to make multiple passes over the surface being painted to achieve an even coating.

The continuous supply paint roller devices where pressurized paint is supplied to the inner surface of the roller have been an improvement, but it has been difficult to achieve a uniform flow of paint to the roller surface, and such rollers are difficult to clean after use and are prone to being plugged by the paint.

It has been found that when a continuous uniform supply of paint is supplied to the roller surface that the operator can more rapidly apply a uniform coating to the surface being painted.

SUMMARY OF THE INVENTION

The invention is a pressure roller applicator having a double curved liquid delivery tube plugged at its distal end and connected to a source of pressurized paint at its other end. The delivery tube has a plurality of holes for delivery of paint interspaced proximate its plugged end, along a straight section of the delivery tube. This straight diffuser part of the liquid delivery tube terminates in the plugged end and is located concentrically within a tubular cylinder composed of a plurality of identical plastic distributor blocks, and respective end blocks which have tapered surfaces for sealing the respective ends of the roller sleeve.

An object of the invention is to provide a continuous uniform supply of paint to the roller surface so as to permit the paint to be uniformly coated on a surface being painted so as to minimize the operator's work in applying the paint.

Another object of the invention is to provide an improved design for providing a uniform distribution of paint along the length of the paint roller.

Another object of the invention is to provide a paint roller constructed of modular elements so as to permit use with paint rollers of different lengths.

A feature of the invention is that the roller applicator may be made in any standard length by varying the number of plastic distributor blocks between the applicator ends.

Another feature of the invention is that the plastic distributor blocks cooperate with the roller sleeve to form multiple paint resevoirs between the the outer surface of the distributor blocks and the inner surface of the roller sleeve.

Another feature of the invention is that the distributor blocks have outwardly extending positioning tabs to fit into the recesses in the adjacent distributor blocks.

Another feature of the invention is that the roller applicator has tapered ends.

The principal advantage of the invention is that the improved modular roller applicator provides uniform distribution of paint along the length of the inner surface of a permeable roller.

An advantage of the invention is that it provides a pressure feed roller applicator to distribute paint evenly along the length of the roller.

Another advantage of the invention is that the roller applicator assembly can be easily and completely disassembled for cleaning.

Another advantage of the invention is that the distributor blocks can be individually replaced when one becomes unusable.

Another advantage of the invention is that the tapered roller applicator ends seal against the inside of the roller sleeve so as to minimize paint leakage.

BRIEF DESCRIPTION OF THE DRAWINGS

FIG. 1 is an overall view of the invention showing the applicator in a cross sectional.

FIG. 2 is an enlarged detailed sectional view taken approximately at 2—2 of FIG. 1.

FIG. 3 is an enlarged end view of one of the modular elements.

DESCRIPTION OF THE PREFERRED EMBODIMENT

The present invention is intended for use in conjunction with tubular roller sleeves having perforations therethrough and typically having an outer fabric or wool applicating surface, where coating liquid passes through the perforations from the inside of the sleeve and is collected in the outer covering material for subsequent transfer to a wall or other surface.

FIG. 1 illustrates an overall cross sectional view of the roller applicator 10. Roller applicator 10 is composed of the outer end cap 11, the modular applicator portion 12, the inner end cap 13, and the pressure feed tube 14.

The outer end cap 11 is circular in cross sectional area and is preferably molded from a plastic material. There are bolt holes 15 formed parallel to the axis of the end cap 11 which the retaining bolts 16 pass through.

There is a circular central recess 17 extending outwardly from the inner edge of the end cap 11. The central recess 17 is of a size suitable to receive the terminal end 18 of the pressure feed tube 14.

The circumferential surface 19 of the end cap 11 is tapered. The tapered surface 19 has its smaller diameter adjacent the modular applicator portion 12. There is a protruding shoulder 20 extending outwardly from the tapered surface 19 distal to the modular applicator portion 12.

The modular applicator portion 12 is constructed from a plurality of modular distributor blocks 21. Each distributor block 21 is preferably molded from a single piece of plastic material.

FIG. 3 illustrates an end view of one such distributor block 21. The distributor block is preferably hexagonal in cross section and has outer grooves 22 extending inwardly from each face of the hexagon. The outer grooves 22 are disposed centrally in each face so that the outer surface of the distributor block 21 has alternating ridges 23 and grooves 22.

The distributor block 21 has a centrally located, substantially circular, central aperture 24 formed in it. Inner slots 25, located between each pair of outer grooves 22, extend outwardly from the central aperture 24 toward the ridges 23 of the hexagonal distributor block 21.

Locator tabs 26 are formed on each end of the distributor block 21. The locator tabs 26 are preferably located radially inwardly from the outside grooves 22, between the outside grooves 22 and the central recess 24.

The outer grooves 22 and the inner slots 25 have substantially the same width, which is substantially the same as the diameter of a retaining bolt 16, and the width of the locator tabs 26.

The roller applicator 10 is assembled as shown in FIG. 1, distributor blocks 21 are arranged along the length of the pressure feed tube 14 with the distributor blocks 21 arranged end to end. The distributor blocks are rotatably offset by the locator tabs 26. The locator tabs 26 of the first distributor block 21 fit into the inner slots 25 of the adjacent distributor block 21 so that the outer groove 22 of the first distributor block confronts a slot 25 of the adjacent distributor block. The bolts 16 pass through holes 15 in end cap 11, and then alternately through grooves 22 and slots 25 of respective adjacent distributor blocks 21. The distal ends of bolts 16 are either threadably attached to inner end cap 13 or are threadably attached to fasteners adjacent end cap 13.

The inner end cap 13 is preferably made in two parts, a first retained part 28 and the second detachable part 29. The retained part 28 is circular in cross section and fits abutting the end of the distributor block 21, and is held thereto by bolts 16.

Retained part 28 is preferably positioned by the retainer bolts 16 being fitted into threaded holes 30 in it. Retained part 28 has a central hole 31 passing through it of a size suitable to fit around the pressure feed tube 14. On the face of the retained part 28 adjacent the distributor blocks 21 an annular recess 32 is formed to receive the locating tabs 26 of the adjacent distributor block 21.

The outer side of the retained part 28 extends from the distributor blocks into a tubular outside threaded portion 33. At this end of the retained part 28 the central recess is counterbored to a large diameter to receive a locator ring 34 affixed to the pressure feed tube 14. An O-ring 36 is placed therebetween to seal the paint within the applicator 10. The detachable part 29 of the inner end cap 13 is circular in cross section and has a hole centrally passing through it. The inner end of detachable part 29 has a central threaded recess to fit about and receive the threaded portion 33 of the retained part 28.

The outer surface 38 of the detachable part 29 of the inner end cap 13 is tapered, having a lesser diameter where it abuts the retained part 28. The tapered surface 38 terminates with an abrupt increase in the diameter of the detachable part 29. The increase in diameter forms a retaining shoulder 39.

In operation the unitary assembly comprising end cap 11, modular distributor blocks 21 and retained part 28 are held together by bolts 16. This unitary assembly is inserted into a permeable roller sleeve 40. The roller sleeve 40 fits over the outer tapered surface 19 of the outer end cap and its end abuts against the shoulder 20 of the outer end cap 11, creating a seal between the inner surface of roller sleeve 40 and the tapered surface 19 to prevent the escape of paint.

The detachable portion 29 of the inner end cap 13 is then screwed onto the threaded portion 33 of the retained part 28 of the inner end cap 13. The tapered outer surface 38 of the detachable part 29 slides within the roller sleeve 40 and seals against it. As the detachable part 29 is screwed more tightly, the retainer shoulder 39 confronts the end of the roller sleeve 40. The roller sleeve is thus sealed against the tapered outer surface and shoulder of the end caps 11, 13. Inlet end 41 of the applicator tube 12 is attached to a supply of continuous pressurized paint. The applicator is now ready for use.

Pressurized paint is conducted through the inlet end 41 of the pressure feed tube 14 and the paint flows to holes 44 in the pressure feed tube 14 inside the modular applicator portion 12. The paint is ejected from the feed tube into the inner slots 25 of the distributor blocks 21. Paint flows outwardly, pooling in the inner slots 25 of the distributor blocks 21. The pooled paint flows out the ends of the inner slots 25 into the adjacent outer grooves 22 of the adjacent distributor blocks 21. The paint is pooled in a reservoir 42 formed between the outer grooves 22, the hexagonal faces of the distributor blocks 21, and the inner surface of the permeable roller sleeve 40. Paint then flows through the roller 40 to the roller nap and transfers to the surface being coated.

Each such distributor block 21 thus forms six reservoirs 42 around its circumference feeding the paint to segments of the inner surface of the roller sleeve 40 where it may pass through the permeable roller 40 into the nap on the roller.

In an alternate form of the invention, the locator tabs 26 on the distributor blocks 21 are omitted and the distributor blocks 21 are retained in the desired position by bolts 16 passing through alternately, outer grooves and inner slots.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A modular roller applicator sized to internally accept and fit about a pressure feed tube and to fit inside a rigid tubular permeable roller sleeve comprising, (a) a first circular end cap, having an inner recess adapted for fitting about said feed tube and an outer circumferential surface adapted for fitting into said tubular permeable roller;

(b) a plurality of identical modular sections, each having a regular polygonal cross section having outer faces, and end surfaces, and having an elongated groove inwardly extending from each outer face and along the length thereof between each end surface, forming alternate ridges and grooves on the outer face, and the elongated grooves and the outer faces of the modular sections and the tubular permeable roller sleeve defining a plurality of reservoirs around each modular section, and each modular section having a central aperture extending between the end surfaces thereof, and each central aperture having elongated inner slots extending outwardly therefrom along the length thereof between the end surfaces toward vertices of the polygonal cross section of each modular section whereby the inner slots overlap the outer face grooves in the adjacent modular section;

(c) a second circular end cap having an inner edge, an outer edge, and a circumferential surface adapted for fitting into said tubular permeable roller; and (d) an elongated fastening means extending from the first end cap to the second end cap and cooperating with the plurality of modular sections to retain the modular sections adjacently therebetween and further cooperating to axially locate and fixedly position the elongated inner slots of the one modular section confronting the elongated outer face grooves of the adjacent modular section.

2. A modular roller applicator in accordance with claim 1, wherein the modular sections each have a locator means affixed to their one end surfaces for locating the inwardly extending elongated groove of the one modular section confronting the elongated inner slot of the adjacent modular section.

3. A modular roller applicator in accordance with claim 2 wherein the locator means further comprise tabs protruding from the one end surfaces of said modular sections.

4. A modular roller applicator in accordance with claim 3 wherein the locator means further comprise tabs protruding from both end surfaces of said modular sections.

5. A modular roller applicator in accordance with claim 3 wherein said tabs protrude outwardly and are sized to fit into adjacent elongated slots.

6. A modular roller applicator in accordance with claim 1 wherein the regular polygonal cross section is a hexagonal cross section.

7. A modular roller applicator in accordance with claim 1 wherein said first end cap has a tapered circumferential surface expanding away from the inner edge adjacent the modular section to a raised shoulder to sealingly fit within the permeable roller.

8. A modular roller applicator in accordance with claim 1 wherein said first and second end caps each have an outwardly extending shoulder protruding from the circumferential surface near the outer edge to retain the permeable roller.

9. A modular roller applicator in accordance with claim 1 wherein said first end cap has a central recess extending inwardly with a diameter suitable to snugly receive the pressure feed tube.

10. A modular roller applicator in accordance with claim 1 wherein the second circular end piece is bifurcated, the first part being attached adjacent the modular sections by the elongated fastening means, the second part removably attached to the first part to allow insertion into the permeable roller sleeve when the second part is removed and retention of the permeable roller when the second part is attached.

11. A modular roller applicator in accordance with claim 1 wherein the second end cap has a central opening for insertion of the pressure feed tube therethrough.

* * * * *